United States Patent [19]

Skaggs

[11] 4,238,031

[45] Dec. 9, 1980

[54] EDGE PROTECTOR

[75] Inventor: Boyd T. Skaggs, Louisville, Ky.

[73] Assignee: Container Corporation of America, Chicago, Ill.

[21] Appl. No.: 80,518

[22] Filed: Oct. 1, 1979

[51] Int. Cl.[3] ..... B65D 81/02; B65D 85/48; B65D 59/00

[52] U.S. Cl. ..... 206/453; 206/454; 206/586; 206/594; 206/521; 220/445; 229/DIG. 1

[58] Field of Search ..... 206/453, 454, 521, 586, 206/594, 418, 448; 220/445; 217/65; 229/39 B, DIG. 1

[56] References Cited

U.S. PATENT DOCUMENTS

| | | | |
|---|---|---|---|
| 975,121 | 11/1910 | Carter | 220/445 |
| 1,936,733 | 11/1933 | Richardson | 217/65 |
| 2,226,601 | 12/1940 | Euller | 206/453 |
| 3,240,417 | 3/1966 | Andreini | 206/418 |
| 3,335,932 | 8/1967 | Brown | 206/453 |
| 3,403,778 | 10/1968 | Voytko et al. | 206/448 |
| 3,532,263 | 10/1970 | Ross | 229/39 B |

*Primary Examiner*—William T. Dixson, Jr.
*Attorney, Agent, or Firm*—Richard W. Carpenter

[57] ABSTRACT

A pair of panels defining, with a connecting strip, a channel for receiving a marginal portion of a sheet of glass.

3 Claims, 3 Drawing Figures

EDGE PROTECTOR

SUMMARY OF THE INVENTION

This invention relates to packaging elements and more particularly to edge protectors used in the packaging of fragile sheet material such as glass.

It is an object of the invention to provide a one-piece paperboard edge protector for engaging a marginal portion of a sheet of glass and holding it in position within an outer container and protecting the edges of the glass.

A more specific object is the provision of a paperboard edge protector and spacer which includes a pair of parallel panels joined to each other by a connecting strip and having tabs projecting beyond the connecting strip.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
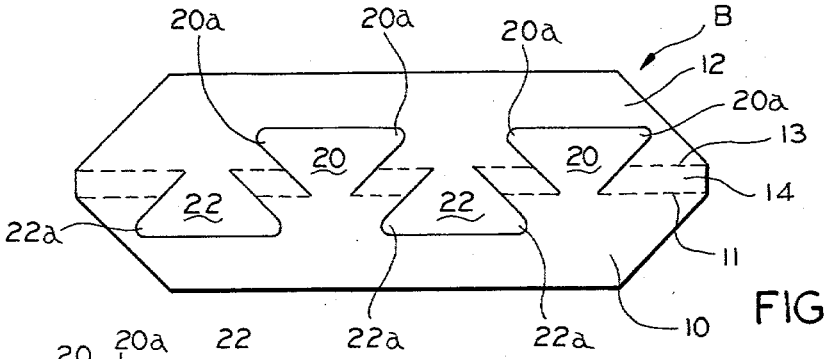
FIG. 1 is a plan view of a blank from which the edge protector, embodying features of the invention and illustrated in the other views, may be formed.
Figure 2:
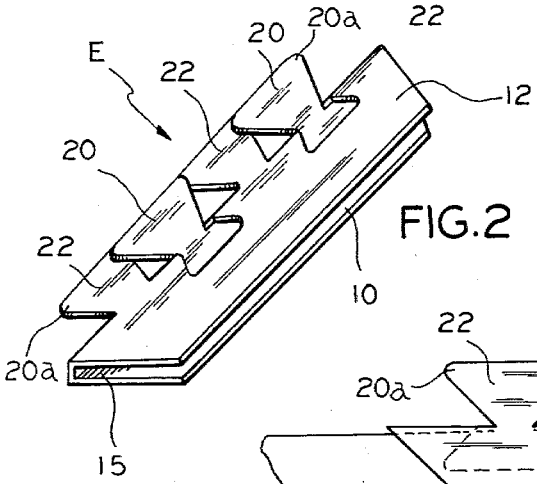
FIG. 2 is a perspective view of the edge protector embodying features of the invention, as seen in the erected condition.

Referring now to the drawings for a better understanding of the invention, it will be seen that the novel edge protector, indicated generally at E and illustrated in FIG. 2 of the drawings, may be formed from a unitary blank B of foldable sheet material illustrated in FIG. 1.

Figure 3:
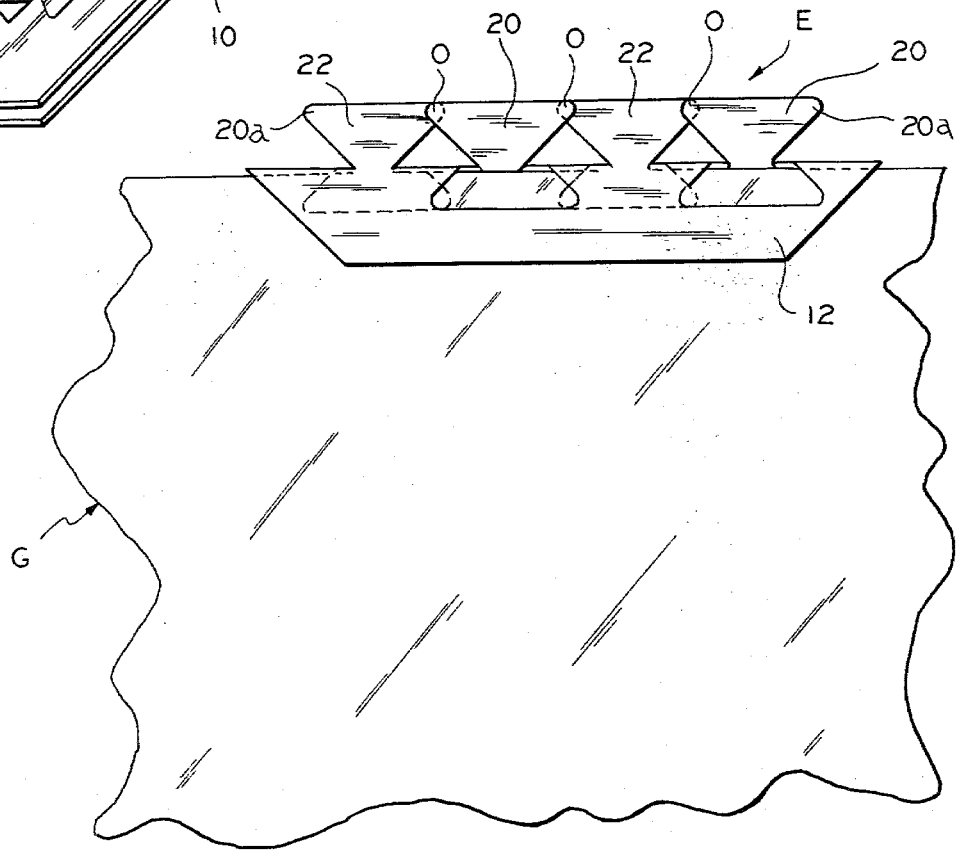
FIG. 3 is a fragmentary plan view illustrating the application of the edge protector to a sheet of fragile material such as glass.

The purpose of the edge protector E is illustrated in FIG. 3 where it is shown as applied to one edge of a sheet of fragile material such as glass, indicated generally at G.

Although only one protector is shown in the drawings, it is to be understood that when a sheet of glass G is packaged, one or more protectors E is placed along each of the edges of the sheet of glass before it is inserted into an outer container or wrapping, not shown in the drawing.

The purpose of the protector is to cushion the edges of the glass within the outer container and keep it spaced properly from the walls of the outer wrapping or container.

As best seen in FIGS. 1 and 2, the protector E includes a pair of relatively narrow, elongated, flat first and second panels 10 and 12, respectively. The panels are joined to each other by an elongated, narrow, connecting hinge strip 14, which is foldably joined along opposite side edges to corresponding outer edges of panels 10 and 12 along fold lines 11 and 13, respectively.

As best seen in FIG. 2, panels 10 and 12, together with connecting hinge strip 14, define an opening or channel 15 adapted to receive a marginal portion of the sheet of glass G.

As best seen in FIG. 1, each of the panels 10 and 12 have projecting from the adjacent outer edges thereof, a plurality of alternately spaced, triangularly shaped tabs 20 and 22, respectively. Each of the tabs has a truncated corner thereof extending integrally from its related panel at a location where the fold line joining the related panel to the connecting strip is interrupted. Thus, the widest portion of the tab is spaced outwardly from and presents an outer edge generally parallel to the fold line. Each tab is formed from material cut from portions of the hinge strip and the panel other than the panel to which it is attached.

When the panels 10 and 12 are folded toward parallel relationship with each other, as seen in FIG. 2, the outer corners **20*a* of tabs 20, and 22*a* of tab 22, overlap to resist the movement of the panels all the way toward each other or even into parallel planes. The purpose of this is to permit the protector to be rapidly erected with the panels being brought toward each other but still kept far enough apart initially to provide a large enough opening 15** so the protector can easily be placed over the edge of the glass G. Once in position, of course, the panels of the protector can be moved into face to face relation with opposed surfaces of the glass as pressure is exerted by an outer container or wrapper.

The other purpose of the tabs, in addition to facilitating assembly of the package, is to serve as a means of positioning the glass and protectors within an outer container or wrapping.

I claim:

1. An edge protector, formed of a unitary blank of foldable paperboard, for holding and positioning within an outer package an edge portion of a sheet of fragile material such as glass, and comprising:

(a) a pair of relatively narrow, elongated first and second panels;

(b) a narrow connecting hinge strip foldably joined at its opposed side edges to corresponding outer edges of respective first and second panels along parallel, interrupted fold lines;

(c) each of said panels having projecting from the outer edges thereof beyond said hinge strip a plurality of lock tabs formed from material cut from portions of said hinge strip and the other panel of said pair and spaced alternately between corresponding tabs projecting from said other panel;

(d) each of said tabs being generally triangular in shape, with one truncated corner thereof extending from its related panel at a location where the fold line joining said related panel to said hinge strip is interrupted and with its widest portion being spaced from said related panel and presenting corner portions which overlap corner portions of adjacent tabs of the other panel to resist the panels from being folded into face to face relation when said panels are folded toward each other about said fold lines to form with said hinge strip a channel for receiving an edge portion of said sheet of glass.

2. An edge protector, formed of a unitary blank of foldable paperboard, for holding and positioning within an outer package an edge portion of a sheet of fragile material such as glass, and comprising:

(a) a pair of relatively narrow, elongated first and second panels;

(b) a connecting hinge strip foldably joined at its opposed side edges to corresponding outer edges of respective first and second panels along parallel, interrupted fold lines;

(c) each of said panels having projecting from the outer edges thereof beyond said hinge strip a plurality of lock tabs formed from material cut from portions of said hinge strip and the other panel of said pair;

(d) each of said tabs extending from its related panel at a location where the fold line joining said related panel to said hinge strip is interrupted and presenting outer portions which overlap outer portions of adjacent tabs of the other panel to resist the panels from being folded into face to face relation when said panels are folded toward each other about said fold lines to form with said hinge strip a channel for receiving an edge portion of said sheet of glass.

3. An edge protector, formed from a unitary blank of foldable paperboard for holding and positioning a sheet of fragile material such as glass, within an outer container, and comprising:

(a) a pair of panels foldably connected to each other by a hinge strip and having a plurality of alternately spaced tabs extending from corresponding edges thereof beyond said hinge strip;

(b) said tabs having portions overlapping corresponding portions of adjacent tabs when said panels are folded toward each other.

* * * * *